US007478508B2

(12) United States Patent
Peterson

(10) Patent No.: US 7,478,508 B2
(45) Date of Patent: Jan. 20, 2009

(54) MOUNTING CLIP

(75) Inventor: Neal L. Peterson, Philomath, OR (US)

(73) Assignee: Scafco Corporation, Spokane, WA (US)

( * ) Notice: Subject to any disclaimer, the term of this patent is extended or adjusted under 35 U.S.C. 154(b) by 839 days.

(21) Appl. No.: 10/919,783

(22) Filed: Aug. 16, 2004

(65) Prior Publication Data

US 2006/0032180 A1 Feb. 16, 2006

(51) Int. Cl.
*E04B 1/343* (2006.01)

(52) U.S. Cl. ..... 52/573.1; 52/713; 248/300

(58) Field of Classification Search ..... 52/98, 52/167.1, 713, 714, 715, 489.1, 573.1; 248/224.8, 248/225.11, 227.3, 295.11, 298.1, 300, 223.41, 248/297.21, 226.11; 403/3, 4, 205, 231, 403/403

See application file for complete search history.

(56) References Cited

U.S. PATENT DOCUMENTS

| | | | | | |
|---|---|---|---|---|---|
| 2,815,599 | A * | 12/1957 | Jablon | 40/709 |
| 2,841,904 | A * | 7/1958 | Jablon | 40/701 |
| 2,906,380 | A * | 9/1959 | Sanders | 52/633 |
| 3,003,600 | A * | 10/1961 | Mackenzie | 52/633 |
| 3,490,797 | A * | 1/1970 | Platte | 52/282.1 |
| 4,035,093 | A * | 7/1977 | Redshaw | 403/4 |
| 4,140,294 | A * | 2/1979 | Zwarts | 248/265 |
| 4,498,654 | A * | 2/1985 | Cooper | 248/251 |
| 5,029,790 | A * | 7/1991 | Payne | 248/287.1 |
| 5,467,566 | A * | 11/1995 | Swartz et al. | 52/235 |
| 5,577,860 | A * | 11/1996 | Plank | 403/403 |
| 5,664,392 | A * | 9/1997 | Mucha | 52/715 |
| 5,720,571 | A * | 2/1998 | Frobosilo et al. | 403/403 |
| 5,846,018 | A * | 12/1998 | Frobosilo et al. | 403/403 |
| 5,876,006 | A * | 3/1999 | Sharp et al. | 248/297.21 |
| 5,906,080 | A * | 5/1999 | diGirolamo et al. | 52/243.1 |
| 6,213,679 | B1 * | 4/2001 | Frobosilo et al. | 403/403 |
| 6,591,562 | B2 * | 7/2003 | Ting | 52/235 |
| 6,612,087 | B2 * | 9/2003 | diGirolamo et al. | 52/712 |
| 6,688,069 | B2 * | 2/2004 | Zadeh | 52/715 |
| 7,104,024 | B1 * | 9/2006 | diGirolamo et al. | 52/710 |
| 7,293,393 | B2 * | 11/2007 | Kelly et al. | 52/665 |
| 2002/0023405 | A1 * | 2/2002 | Zadeh | 52/714 |

FOREIGN PATENT DOCUMENTS

JP 08158516 A * 6/1996

* cited by examiner

*Primary Examiner*—Robert J Canfield
*Assistant Examiner*—Charissa Ahmad
(74) *Attorney, Agent, or Firm*—Wells St. John P.S.

(57) ABSTRACT

A mounting clip is described and which includes a clip body which has an aperture formed therein; and an engaging component is provided and which is received in the aperture and which moveably mounts the clip body to a first structural member and which facilitates the movement of the clip body along individual first and second paths of travel which are substantially normal one relative to another.

16 Claims, 5 Drawing Sheets

MOUNTING CLIP

TECHNICAL FIELD

The present invention relates to a mounting clip which finds usefulness in the construction of buildings, and more specifically to a mounting clip which facilitates the movement of a construction component along individual paths of travel which are substantially normal one relative to the other.

BACKGROUND OF THE INVENTION

In U.S. Pat. No. 5,876,006, a stud mounting clip is described and which is useful in the construction of buildings, and particularly light commercial buildings. The teachings of this patent are incorporated by reference herein. As described more fully in U.S. Pat. No. 5,876,006, it is not uncommon for buildings to settle on their foundations once constructed. This settling of the building can cause damage to the surrounding foundation and to interior structures such as floors and the like as exterior walls go out of plumb. Yet further, in the construction of certain light commercial buildings it is not uncommon for the exterior walls and frames of the building to be manufactured from materials having different coefficients of expansion from that of the exterior sheathing of the structure. With the exposure of the building to extremes of temperature, gaps are often produced in the exterior sheathing panels, thereby allowing cold air and moisture to enter the structure.

Various slide clips of assorted designs have been suggested through the years, an example of two related slide clip arrangements are shown in U.S. Pat. Nos. 5,720,571 and 5,467,566, the teachings of which are also incorporated by reference herein.

While these prior art patents, noted above, and the teachings associated therewith have operated with some degree of success, shortcomings have remained in the use of these prior art clip arrangements. Among the chief difficulties associated with these assemblies is that most of the prior art assemblies have been designed for use in supporting construction members, and the like, and which move generally in a vertical direction relative to a supporting stud. Moreover, and as outlined more fully in U.S. Pat. No. 5,720,571, many of the prior art clips do not provide the necessary off-set required to accommodate the flange thickness of studs and as a result the clips are not installed flush to the surface of any supporting surface that it is being installed on. As a result, welds or mechanical fasteners are required to bridge the resulting gap and consequently their holding values are not as predictable as those made when surface-to-surface contact is maintained in the installation of same.

Therefore, a mounting clip which is useful in the construction of various buildings and which overcomes the shortcomings attendant with the prior art devices and practices is the subject matter of the present application.

SUMMARY OF THE INVENTION

A first aspect of the present invention relates to a mounting clip which includes a clip body which has an aperture formed therein; and an engaging component received in the aperture and which moveably mounts the clip body to a first structural member and which facilitates the movement of the clip body along individual first and second paths of travel which are substantially normal one relative to another.

Another aspect of the present invention relates to a mounting clip for joining at least two structural members together and which includes a clip body having a first and a second leg, and wherein one of the first or second legs is affixed to a first structural member, and wherein the other of the first or second legs has an aperture formed therein; an engaging component matingly received in the aperture and affixed to a second structural member, and wherein the engaging component when disposed in a first position renders the clip body moveable along a first path of travel relative to the second structural member, and wherein the clip body when mounted in a second position renders the clip body moveable along a second path of travel relative to the second structural member and which is substantially normal relative to the first path of travel; a securing component mounted on the engaging component and moveably capturing the other of the first or second legs which has the aperture formed therein, and which is located therebetween the securing component and the first structural member; and a fastener received through the engaging and securing components and which secures the mounting clip to the first structural member.

These and other aspects of the present invention will be described in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
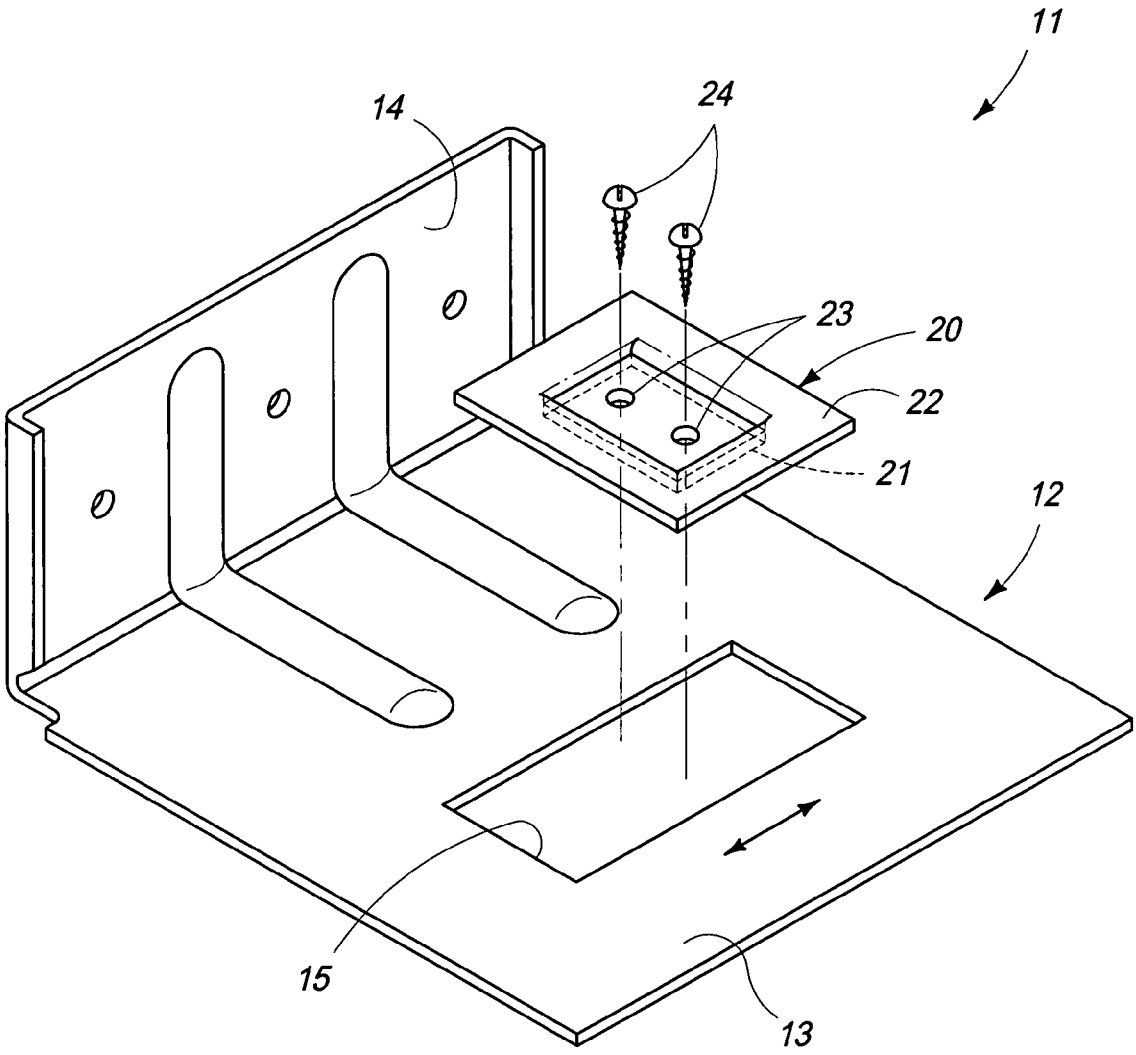
Fig 1 PRIOR ART
FIG. 1 is a perspective, exploded view of a prior art slide clip arrangement.
Figure 2:
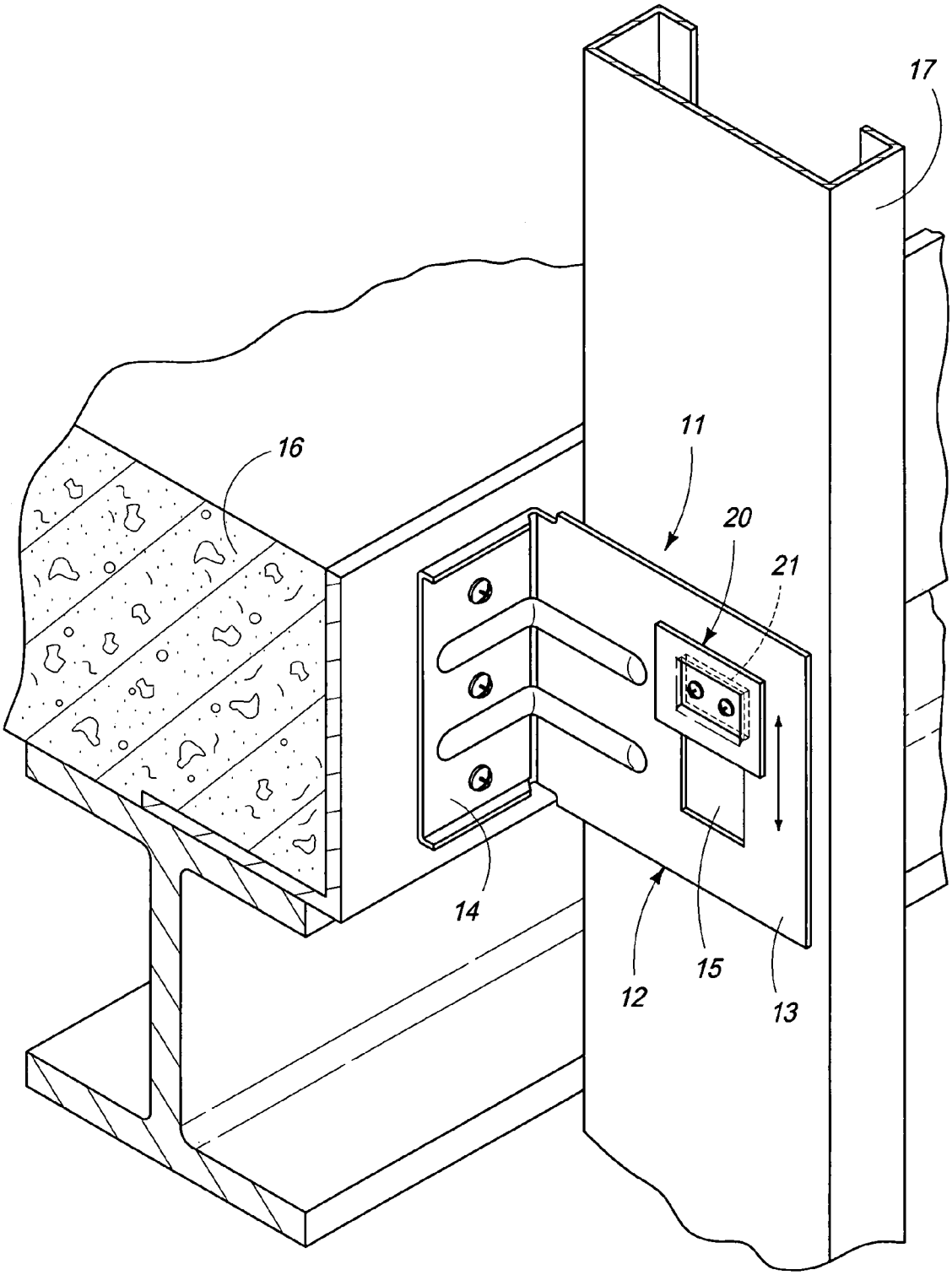
Fig 2 PRIOR ART
FIG. 2 is a second, environmental, perspective view of a prior art slide clip shown in an installed condition.
Figure 3:
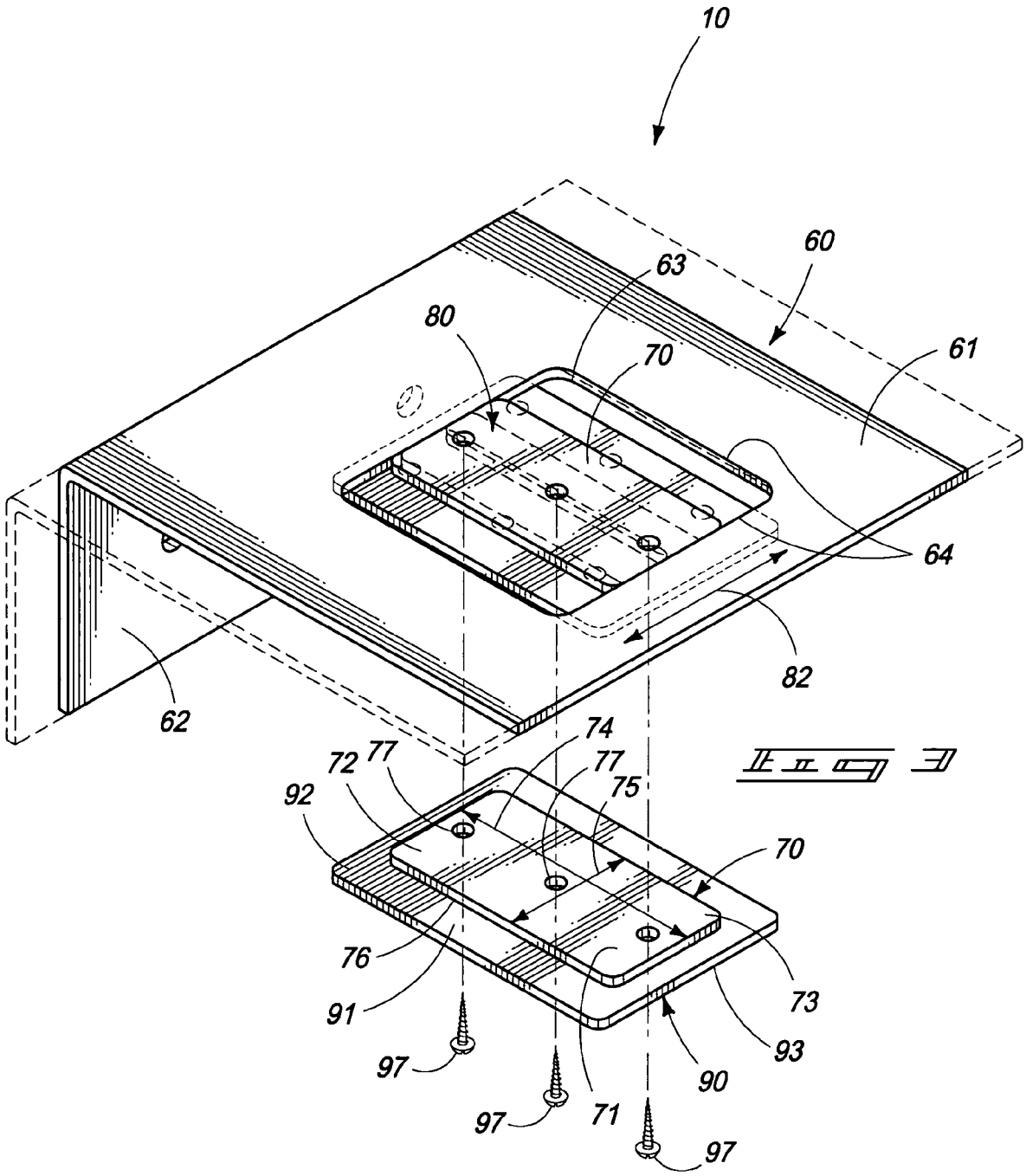
FIG. 3 is a perspective, exploded view of the mounting clip of the present invention shown in a first configuration.

The mounting clip of the present invention is generally indicated by the numeral 10 as seen in FIG. 3 and following. As best seen by reference to FIGS. 1 and 2, a prior art stud mounting clip 11 as more fully described in U.S. Pat. No. 5,876,006 is shown. The teachings of this U.S. patent are incorporated by reference herein. As seen in FIGS. 1 and 2, the prior art stud mounting clip 11 includes a bracket component 12 which has a first and a second leg 13 and 14, respectively. An elongated aperture 15 is formed in the first leg 13 and the bracket component 12 facilitates the vertical movement of a horizontally oriented stud or construction member 16 as seen in FIG. 2. The bracket component 12 is slideably affixed to a vertically oriented stud which is generally indicated by the numeral 17.

The prior art stud mounting clip 11 includes a clip body 20 having an engaging portion 21 which is matingly received within the elongated aperture 15 and further has a securing portion 22 which is fastened thereto. Apertures 23 are formed in the securing and engaging portions 21 and 22 and thereby receive a fastener 24 therethrough and which engages the underlying vertically oriented stud 17. As best appreciated by a study of FIG. 2, the stud mounting clip 11 permits substantially vertical movement of the horizontally oriented stud or construction member 16.

Figure 4:
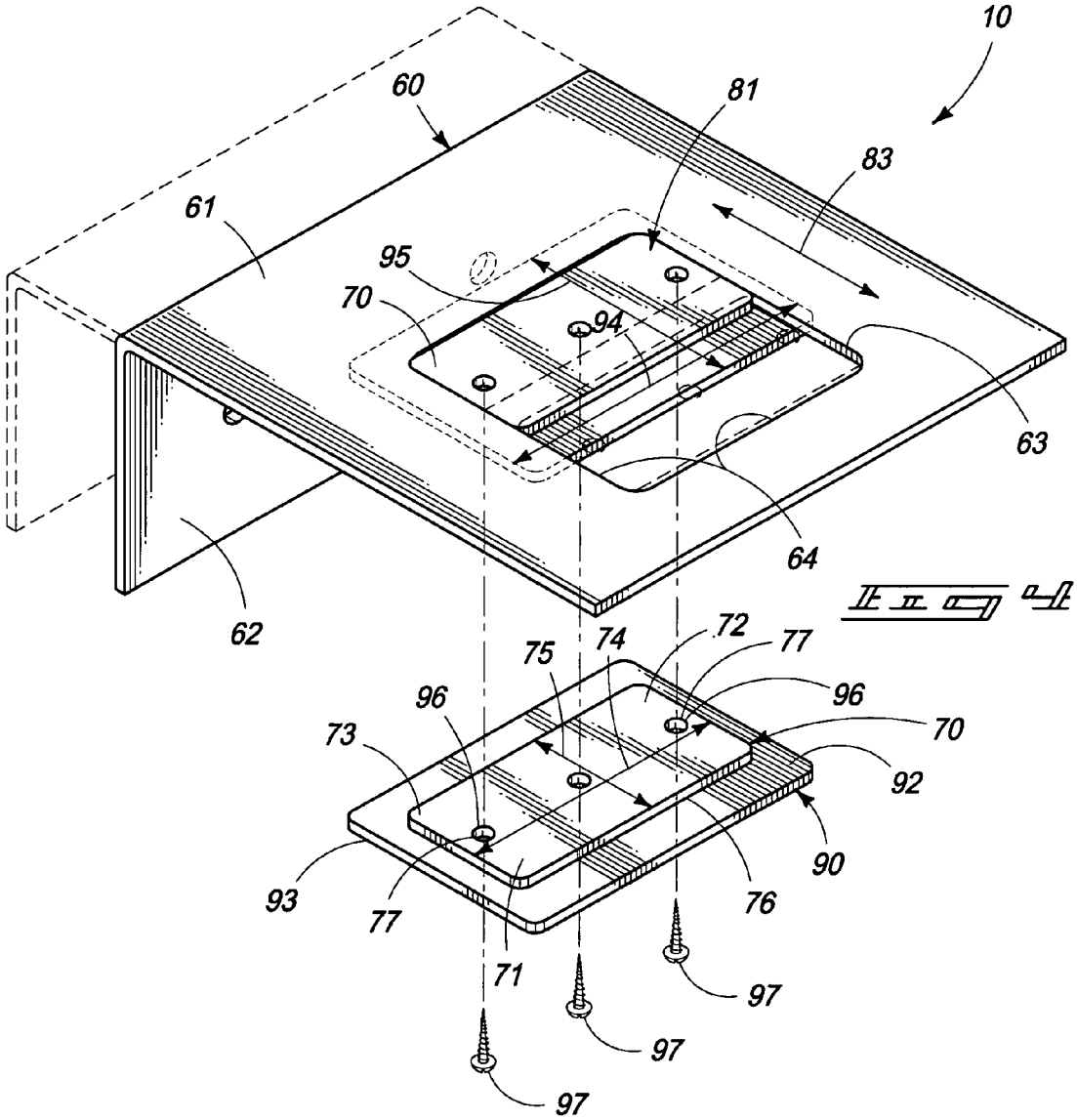
FIG. 4 is a perspective, exploded view of the mounting clip of the present invention shown in a second configuration.
Figure 5:
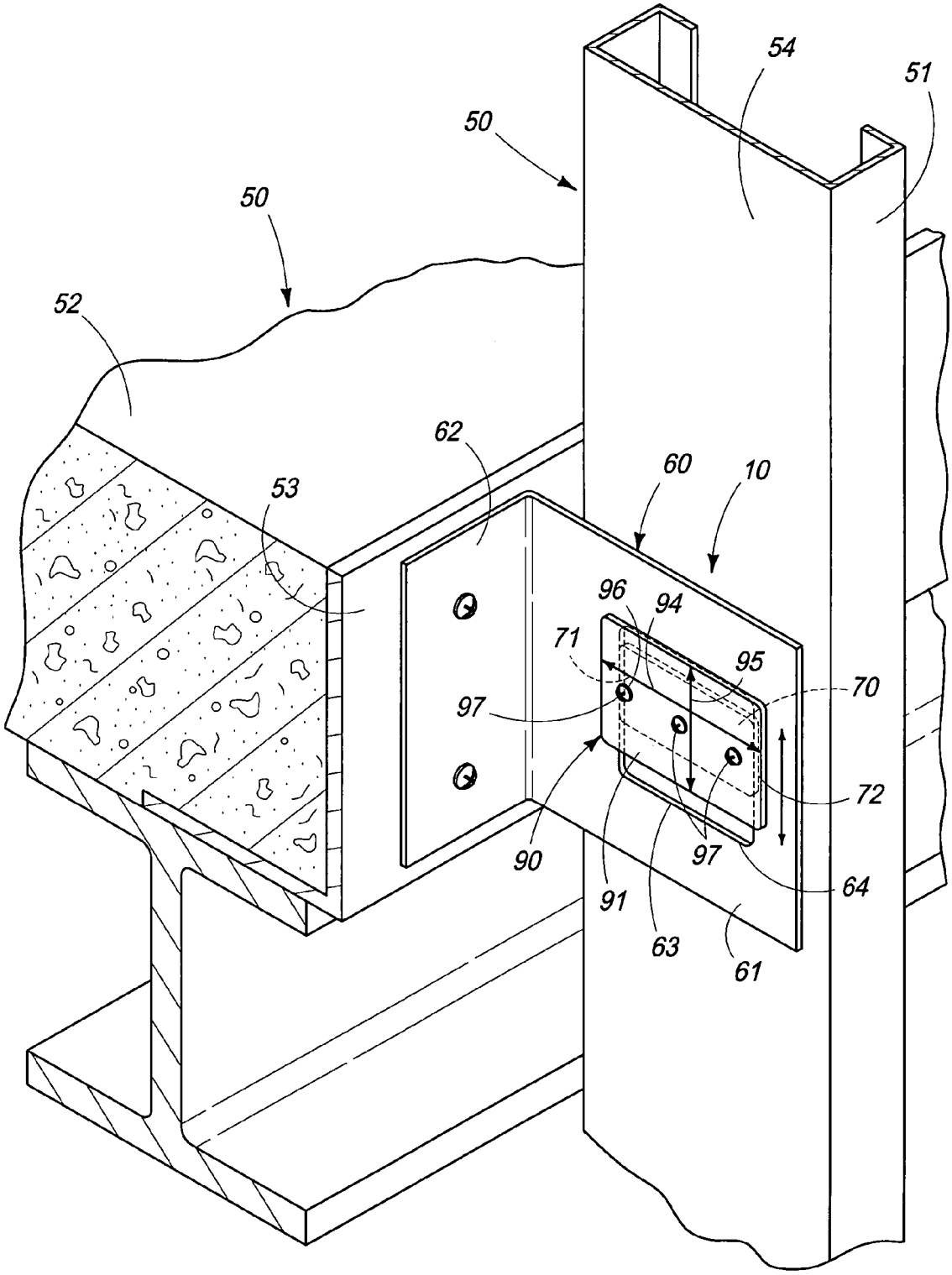
FIG. 5 is an environmental, perspective view of the mounting clip of the present invention shown in an installed condition.

Referring now to FIGS. 3-5, the mounting clip 10 of the present invention is operable to join a pair of structural members generally indicated by the numeral 50 together (FIG. 5). In this regard, the structural members 50 include a first vertically oriented structure member 51 and a second substantially horizontally oriented structural member 52. The first and second structural members 51 and 52 each have respective exterior facing surfaces 53 and 54, respectively. As seen in FIGS. 3 and 4, the mounting clip 10 has a clip body which is generally indicated by the numeral 60. The clip body has a first leg 61, and a second leg 62 which are disposed in substantially normal relation one relative to the other, although it should be recognized that various other angular relationships of the first and second legs are possible. As seen in the drawings, a substantially square aperture 63 is formed in the first leg 61. The substantially square aperture is defined by a number of sides 64. Each of the sides 64 are substantially equal in length. As will be appreciated, while the substantially square aperture 63 is formed in the first leg 61, the same square aperture may be formed in the second leg or alternatively in both the first and second legs.

Referring now to FIGS. 3 and 4, an engaging component 70 is provided. The engaging component is received in the aperture 63 and is operable to moveably mount the clip body 60 to the first structural member 51 (FIG. 5), and which facilitates the movement of the clip body along individual first and second paths of travel which are substantially normal one relative to the other, and which will be described in greater detail below. The engaging component 70 has a main body 71 with opposite first and second ends 72 and 73, respectively. A major length dimension 74 is defined between the first and second ends. As seen in FIGS. 3 and 4, the main body is substantially rectangular shaped and the major length dimension 74 is less than the length dimension of one of the sides 64 of the square aperture 63. Still further, the main body 71 has a minor width dimension 75, which is less than the length dimension of one of the sides 64 of the substantially square aperture 63. In the arrangement as shown, the minor width dimension of the rectangular shaped engaging component 70 is less than about 80% of the length dimension of one of the sides 64 of the substantially square aperture 63. In addition to the foregoing, the main body 71 has a thickness dimension generally indicated by the numeral 76. Further, a plurality of apertures 77 are formed therein and which are operable to receive fasteners which will be described below, and which secure the engaging component 70 to the first structural member 51. As will be recognized by a study of the drawings, the clip body 60 has a thickness dimension, and the thickness dimension 76 of the engaging component 70 is at least equal to or greater than the thickness dimension of the clip body 60. As will be recognized by a study of FIGS. 3-5, the engaging component slideably engages the opposite sides 64 of the square aperture 63 to substantially constrain the movement of the clip body 60 along the respective first and second paths of travel which will be described below. As seen in FIGS. 3 and 4, the engaging component 70 can be located in alternative first and 80 and second 81 positions or orientations relative to the first structural member 51 in order to define first 82 and second 83 paths of travel which are disposed in substantially normal relation one relative to the other. In this regard, and because of the nature of the substantially square aperture 63, and the minor length dimension 75 of the main body 71, the individual paths of travel have a length dimension which is equal to the difference of the length dimension of one of the sides 64 of the substantially square aperture 63, and the minor width dimension 75 of the rectangular shaped main body 71.

A securing component which is generally indicated by the numeral 90, and which has a main body 91 is mounted onto, or made integral with, the main body 71 of the engaging component 70. The securing component is operable to moveably capture the first leg 61 of the clip body 60, and which has the aperture 63 formed therein, between the securing component 90, and the first structural member 61. The main body 91 of the securing component 90 has a first end 92 and an opposite second end 93. The main body defines a major length dimension 94 between the first and second ends. This major length dimension is greater than the length dimension of the respective sides 64 of the substantially square aperture 63. Still further, the main body 91 has a width dimension 95 which may be equal to, greater than, or less than the length dimension of the respective sides 64 which defines the substantially square aperture 63. As will be recognized by a study of the drawings, the major length dimension of the securing component is greater than the major length dimension 74 of the engaging component 70. As seen in FIGS. 3 and 4, a plurality of apertures 96 are formed in the securing component 90 and are substantially coaxially aligned relative to the plurality of apertures 77 formed in the main body 71 of the engaging component. The coaxially aligned apertures are operable to receive fasteners 97 therethrough and which engage the underlying first structural member 51 thereby securing the mounting clip 10 in a given position on the first structural member.

As will be recognized by a study of the drawings, by orienting the engaging component in either the first 80 or second 81 position, the mounting clip is rendered useful for movably affixing the first 51 and second 52 structural members for both vertical and horizontal movement.

Operation

The operation of the described embodiment of the present invention is believed to be readily apparent and is briefly summarized at this point.

A mounting clip 10 for joining at least two structural members 51 and 52 together is shown in FIG. 5. The mounting clip includes a clip body 60 having a first 61 and second 62 leg, and wherein one of the first or second legs has an aperture 63 formed therein. An engaging component 70 is provided and which is matingly received in the aperture 63 and affixed to the first structural member 51. The engaging component when disposed in a first position 80 (FIG. 3) renders the clip body moveable along a first path of travel 82 relative to the first structural member, and wherein the engaging component when mounted in the second position 81 (FIG. 4) renders the clip body 60 movable along a second path of travel 83 relative to the first structural member 51 and which is substantially normal relative to the first path of travel, and wherein the second leg 62 of the clip body is affixed to a second structural member 52. A securing component 90 is provided and mounted on the engaging component 70 and moveably captures the first leg 61 of the clip body and which has the aperture 63 formed therein therebetween the securing component and the first structural member. Further, a fastener 97 is received through the engaging and securing components and which secures the mounting clip to the first structural member. As illustrated in the drawings, the securing component 90 has a length 94 and a width dimension 95. The length dimension of the securing component is greater than the major length dimension 74 of the engaging component 70. Still further, the thickness dimension 76 of the main body 71 is equal to or greater than the thickness dimension of the clip body 60. Consequently, once the clip body is secured by the fasteners 97, the clip body is rendered moveable along the respective first and second paths of travel as described above.

Therefore it will be seen that the mounting clip 10 of the present invention provides many advantages over the prior art devices which have been utilized heretofore. In the arrangement as shown, a mere change of position of the engaging component 70 relative to the underlying supporting structural component renders the mounting clip moveable along two paths of travel which are substantially perpendicular, one relative to the other, thereby increasing the usefulness of such devices in the fabrication of various buildings.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A mounting clip, comprising:

a clip body which has a substantially square aperture formed therein; and an engaging component having a substantially rectangular shaped portion received in the substantially square aperture and which moveably mounts the clip body to a first structural member and which facilitates the movement of the clip body when mounted in a first position along a first path of travel and when mounted in a second position along a second path of travel, and wherein the first and second paths of travel are substantially normal one relative to another without changing orientation of the clip body.

2. A mounting clip as claimed in claim 1, and wherein the clip body has a first and second end, and wherein the substantially square aperture is defined by the first end of the clip body, and the second end of the clip body is fastened to a second structural member, and wherein the first and second structural members can move, one relative to the other.

3. A mounting clip as claimed in claim 2, and wherein the substantially square aperture formed in the clip body has sides which each have a length dimension, and wherein the engaging component has a main body which is substantially rectangular shaped and which has a major and a minor dimension, and wherein the major dimension of the main body is less than the length dimension of one of the sides of the substantially square aperture.

4. A mounting clip as claimed in claim 3, and wherein the minor dimension of the rectangularly shaped engaging component is less than about 80% of the length dimension of one of the sides of the substantially square aperture.

5. A mounting clip as claimed in claim 4, and wherein the clip body has a thickness dimension, and where the engaging component has a thickness dimension which is greater than the thickness dimension of the clip body.

6. A mounting clip as claimed in claim 5, and further comprising:

a securing component mounted on the engaging component and wherein the clip body is moveably captured between the securing component and the first structural member.

7. A mounting clip as claimed in claim 6, and wherein the securing component has a length and width dimension, and wherein the length dimension of the securing component is greater than the major dimension of the engaging component.

8. A mounting clip as claimed in claim 7, and wherein the length and width dimensions of the securing component are different.

9. A mounting clip as claimed in claim 7, and wherein the length and width dimensions of the securing component are the same.

10. A mounting clip as claimed in claim 9, and wherein the engaging component and the securing component each have an aperture formed therein, and wherein the respective apertures are substantially coaxially aligned, and are operable to receive a fastener therethrough, and wherein the fastener engages the first structural member to mount the clip body thereto.

11. A mounting clip for joining at least two structural members together, comprising:

a clip body having a first and a second leg, and wherein one of the first or second legs has an aperture formed therein;

an engaging component having a substantially rectangular shaped portion matingly received in the aperture and affixed to a first structural member, and wherein the engaging component when disposed in a first position renders the clip body moveable along a first path of travel relative to the first structural member, and wherein the engaging component when mounted in a second position renders the clip body moveable along a second path of travel relative to the first structural member and which is substantially normal relative to the first path of travel without changing orientation of the clip body; and wherein the second leg is affixed to a second structural member;

a securing component mounted on the engaging component and moveably capturing the leg which has the aperture formed therein between the securing component and the first structural member; and a fastener received through the engaging and securing components and which secures the mounting clip to the first structural member.

12. A mounting clip as claimed in claim 11, and wherein the first and second legs of the clip body are disposed in a substantially normal relationship one relative to the other.

13. A mounting clip as claimed in claim 11, and wherein the clip body has a thickness dimension, and wherein the engaging component has a thickness dimension greater the thickness dimension of the clip body.

14. A mounting clip as claimed in claim 11, and wherein the securing component has a length and a width dimension, and wherein the length dimension of the securing component is greater than a major length dimension of the engaging component.

15. A mounting clip as claimed in claim 11, and wherein the aperture has opposite sides, and wherein the engaging component slideably engages the opposite sides of the aperture to constrain the movement of the clip body along the respective first and second paths of travel.

16. A mounting clip, comprising:

a clip body which has a square aperture formed therein, the square aperture having four sides of equal length; and an engaging component having a substantially rectangular shaped portion received in the square aperture and which moveably mounts the clip body to a first structural member and which facilitates the movement of the clip body when mounted in a first position along a first path of travel and when mounted in a second position along a second path of travel, and wherein the first and second paths of travel are substantially normal one relative to another.

* * * * *